United States Patent [19]

Wilcox et al.

[11] 4,343,412

[45] Aug. 10, 1982

[54] HINGE FOR CARRYING CASE

[75] Inventors: Donald G. Wilcox, Seymour; Nobile Zambrano, Branford, both of Conn.

[73] Assignee: Show-Pak Incorporated, New Haven, Conn.

[21] Appl. No.: 251,151

[22] Filed: Apr. 6, 1981

Related U.S. Application Data

[63] Continuation-in-part of Ser. No. 236,049, Feb. 19, 1981.

[51] Int. Cl.[3] ..... B65D 43/14; B65D 51/04

[52] U.S. Cl. ..... 220/342; 220/337

[58] Field of Search ..... 220/337, 338, 349, 345, 220/87 R, 334, 342, DIG. 26, 9 R; 150/46

[56] References Cited

U.S. PATENT DOCUMENTS 4,005,800 2/1977 Schurman ..... 220/337

4,029,234 6/1977 Johnson, Jr. et al. ..... 220/337

*Primary Examiner*—George T. Hall

*Attorney, Agent, or Firm*—Curtis, Morris & Safford

[57] ABSTRACT

A blow molded carrying case having a base and a cover for the base is provided with an improved hinge construction in which a pair of oppositely directed hinge pins formed on the cover are received in a pair of spaced hinge pin receiving bosses formed in the base. These bosses receive and partly surround the pins, while a locking strap associated with each of the bosses is secured to the base and has an intermediate portion overlying the pins to trap the same in the recesses of the base.

7 Claims, 4 Drawing Figures

HINGE FOR CARRYING CASE

This application is a continuation-in-part of U.S. patent application Ser. No. 236,049 filed, Feb. 19, 1981.

The present invention relates to blow molded carrying cases, and more in particular, to an improved hinge construction for such cases.

Blow molded carrying cases are relatively light in construction and durable in use. They are particularly suitable for use in carrying tools or toys, because of their lightweight and sturdy construction. Such cases often are provided with a hinged cover on a base, with the hinge construction being formed by integral hinge pins in the cover and pin receiving pockets molded in the base. While this construction has been found to be highly satisfactory for most uses, in heavy duty applications, where heavier objects are to be carried in the case or where the case is to be subjected to particularly high stresses, it has been found desirable to reinforce the hinge to insure permanent attachment of the cover to the base.

It is an object of the present invention to provide a carrying case with an improved hinge construction.

Another object of the present invention is to provide an improved hinge construction in a blow molded carrying case.

A further object of the present invention is to provide a blow molded carrying case with an improved hinge construction that is readily assembled.

Yet another object of the present invention is to provide a lightweight carrying case which is durable in construction.

In accordance with an aspect of the present invention a carrying case is provided which includes a base formed of a one-piece blow molded plastic construction including an upper wall and a rear wall defining a rear edge. A one-piece blow molded cover, having side walls generally complementary in plan to the side walls of the base, is pivotally connected to the base through an improved hinge construction. This hinge construction includes a pair of spaced pin receiving bosses including arcuately shaped outwardly opening recesses formed therein at opposite ends of the rear edge of the base. The cover has a pair of oppositely directed pivot pins formed integrally therewith and respectively received in the recesses of the base. The hinge pins are retained in the recesses of the base bosses by a pair of generally L-shaped locking straps respectively removably secured to the rear edge of the base and overlying the recesses.

The above, and other objects, features and advantages of this invention will be apparent in the following detailed description of an illustrative embodiment thereof, which is to be read in connection with the accompanying drawings wherein.

Figure 1:
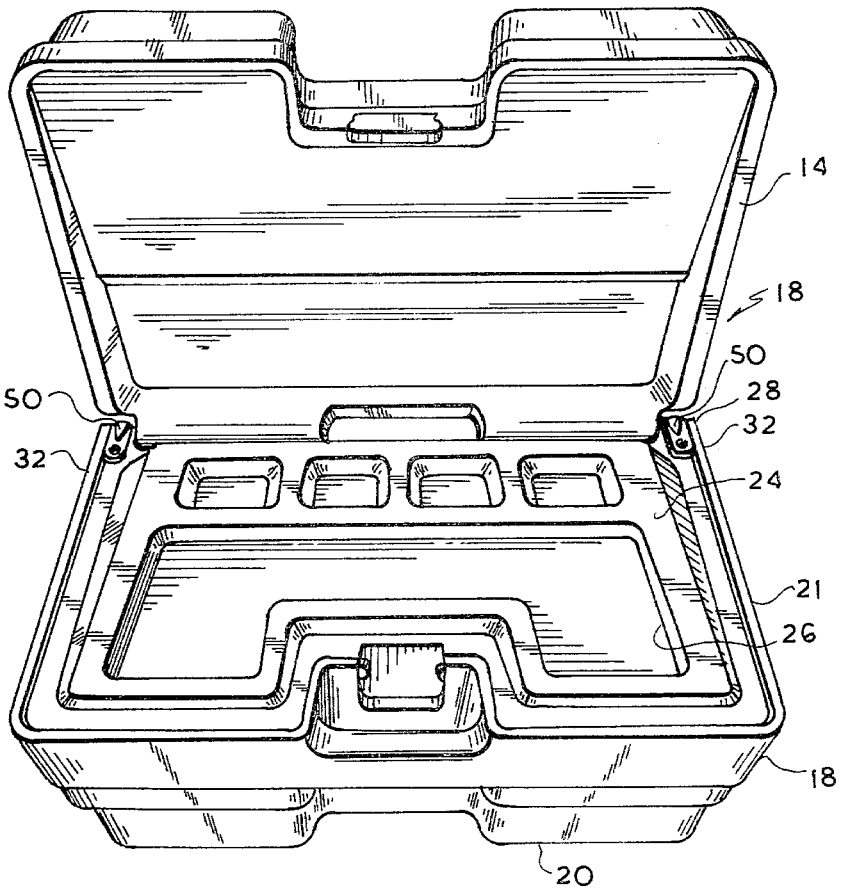
FIG. 1 is a perspective view of a carrying case constructed in accordance with the present invention.
Figure 4:
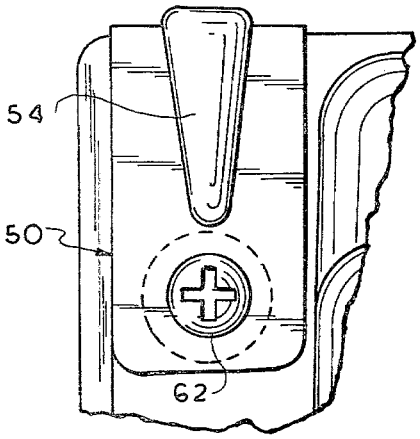
FIG. 4 is a rear view taken along line 4—4 in FIGS. 2 and 3.
Figure 2:
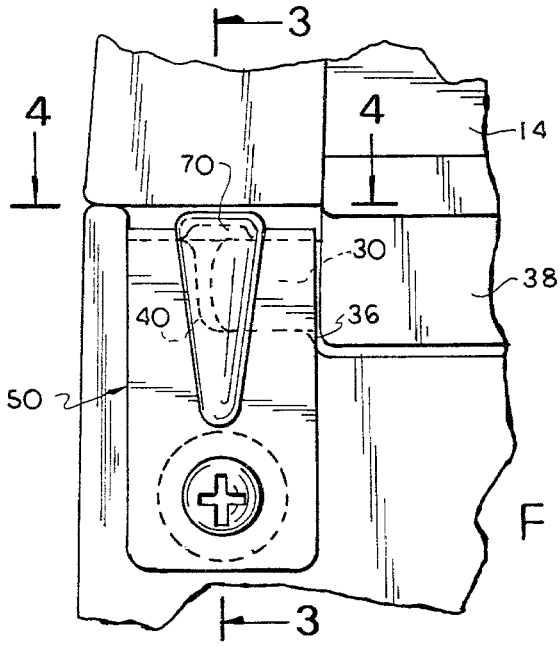
FIG. 2 is a plan view of one hinge connection at one corner of the base of the carrying case shown in FIG. 1, with the cover in its fully opened position.

Referring now to the drawing in detail, and initially to FIG. 1 thereof, a carrying case 10, including a hinge construction in accordance with the present invention is illustrated which includes a base 12 and a cover 14. Both the base and cover are formed using conventional blow molding techniques to create hollow double walled elements. The carrying case construction is described in greater detail in the above-mentioned patent application, the disclosure of which is incorporated herein by reference.

Basically, base 12 includes peripheral side walls 18, bottom and top walls 20, 24, respectively, with the top wall having a central opening 26 therein that provides access to the interior of the base. The rear side walls 18 and top wall 24 define a rear edge portion 28 at which cover 14 is pivotally connected to the base.

Figure 3:
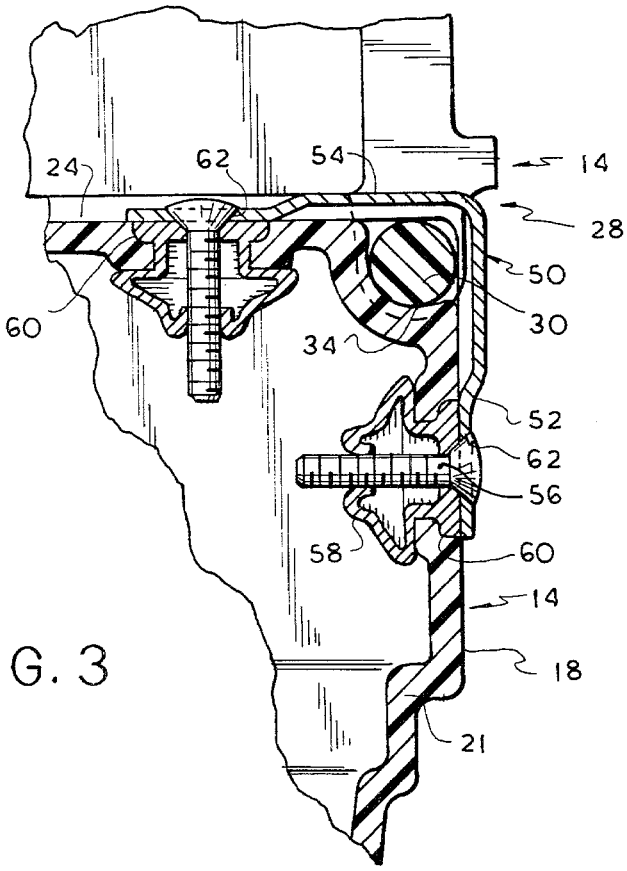
FIG. 3 is a sectional view taken along line 3—3 of FIG. 2.

The cover has a pair of hinge pins 30 integrally formed therewith in the blow molding process at opposite ends of its rear edge. The pins project in opposite directions, and are received in bosses 32 formed at opposite ends of rear edge 28 of base 18. These bosses (one of which is shown in detail in FIG. 3) have arcuately shaped recesses or gudgeons 34 formed therein. These recesses are generally semi-cylindrical, and open outwardly of rear edge 28. Their inner side 36 opens to face the rear edge 38 of cover 14, so that pivot pin 30 is received within the boss. Outer end 40 of recess 34 is closed, to prevent outward movement of the cover relative to the boss. By this construction, pins 30 on the cover are simply seated in recesses 34 in the assembly process, in a convenient operation. No bending of either the base or the cover is required in order to seat the hinge pins in their complementary recesses or trunnions formed by the bosses.

Hinge pins 30 are captured in recesses 34 by L-shaped locking straps 50. These locking straps have angularly related legs 52, 54 respectively secured to rear wall 18 and top wall 24 of base 12, to overly the recesses or gudgeons 34 thereby to trap hinge pins 30 therein.

In the illustrative embodiment of the invention, the free ends of legs 52, 54 are secured to base 12 by so-called "molly" bolts. These "molly" bolts include a screw 56 and a collapsible one-piece washer and nut unit 58. The washer and nut units are inserted in apertures 60 formed in walls 18 and 24. When screw 56 is passed through a corresponding hole 62 in the end of the leg of element 50, and then threaded in the collapsible nut 58, the collapsible nut assumes the compressed configuration illustrated in FIG. 3, locking the strap in place.

In the illustrative embodiment of the invention, straps 50 are reinforced by the provision of a longitudinal bend or reinforcing fold 70 formed therein.

By this construction, the cover is easily mounted on the base, without any distortion in either the base or the cover, in order for the pivotal connection to be made. The connection is rapidly made by a simple screw threading operation, with the stresses of the connection being distributed over a broad area of the plastic walls. In addition, the stresses inherent in the hinge when the cover is operated, are distributed through the strap to broad areas of the base wall and are not applied directly to the hinge connection. Thus, a far more durable and lasting hinge arrangement is provided in the plastic blow molded construction.

Although an illustrative embodiment of the invention has been described herein with reference to the accompanying drawings it is to be understood that the invention is not limited to that precise embodiment, and that various other changes and modifications may be effected therein by one skilled in the art without departing from the scope or spirit of this invention.

What is claimed:

1. In a carrying case having a base and a cover for the base, an improved hinge construction comprising, said cover having a pair of oppositely directed hinge pins formed thereon, said base having a pair of spaced hinge pins receiving bosses formed therein for receiving and only partly surrounding said pins, and a locking strap associated with each boss and secured to said base, having intermediate portions overlying said pins.

2. In a carrying case as defined in claim 1 wherein said base has an upper rear edge and said bosses are formed in said upper rear edge at opposite ends thereof; said bosses having semi-cylindrical recesses formed therein for receiving said pins.

3. In a carrying case a defined in claim 2 wherein said locking straps are generally L-shaped and the portions thereof adjacent the intersection of the legs of the L overly said pins.

4. In a carrying case as defined in claim 3 wherein said straps are removably mounted on the base.

5. In a carrying case as defined in claim 3 wherein said straps are longitudinally recessed to reinforce the straps.

6. In a carrying case as defined in claim 3 wherein said cover and base are blow molded.

7. In a carrying case comprising a base formed of one-piece blow molded plastic construction including an upper wall and a rear wall defining a rear edge for the base, and a one-piece blow molded cover having side walls generally complementary in plan to the side walls of said base, an improved hinge construction comprising, said base having a pair of spaced pin receiving bosses including arcuately shaped outwardly opening recesses formed therein at opposite ends of said rear edge, and said cover having a pair of oppositely directed pivot pins formed integrally therewith and respectively received in said recesses; and a pair of generally L-shaped locking straps respectively removably secured at opposed ends of said rear edge overlying said recesses thereby to trap said pins in said recesses.

* * * * *